US007096625B1

(12) United States Patent
Hering

(10) Patent No.: US 7,096,625 B1
(45) Date of Patent: Aug. 29, 2006

(54) METHOD OF DISPLAYING ADVERTISING ON A TURNSTILE

(76) Inventor: Martin Hering, 9515 Belmont Ter., Oviedo, FL (US) 32765

( * ) Notice: Subject to any disclaimer, the term of this patent is extended or adjusted under 35 U.S.C. 154(b) by 0 days.

(21) Appl. No.: 09/705,152

(22) Filed: Nov. 2, 2000

Related U.S. Application Data

(63) Continuation of application No. 09/309,025, filed on May 10, 1999, now abandoned, which is a continuation of application No. 08/740,879, filed on Nov. 4, 1996, now Pat. No. 5,979,113, which is a continuation-in-part of application No. 08/450,496, filed on May 26, 1995, now Pat. No. 5,570,541, which is a continuation-in-part of application No. 08/189,802, filed on Feb. 1, 1994, now Pat. No. 5,430,974.

(51) Int. Cl.
*E06B 11/08* (2006.01)

(52) U.S. Cl. ..... 49/46; 49/42

(58) Field of Classification Search ..... 49/47, 49/48, 42, 46; 40/660, 661, 660.12
See application file for complete search history.

(56) References Cited

U.S. PATENT DOCUMENTS

| | | | | | |
|---|---|---|---|---|---|
| 1,606,566 | A | * | 11/1926 | Flowers | 246/293 |
| 1,632,211 | A | * | 6/1927 | Baltzley | 116/63 R |
| 2,068,323 | A | * | 1/1937 | Harrison et al. | 40/502 |
| 2,768,457 | A | * | 10/1956 | Biek | 40/660 |
| 3,077,981 | A | * | 2/1963 | Gaspard | 40/660 |
| 3,306,266 | A | * | 2/1967 | McCunney | 40/660 |
| 3,315,632 | A | * | 4/1967 | Hyden | 116/223 |
| 3,560,996 | A | * | 2/1971 | Berl | 49/47 |
| 3,586,320 | A | * | 6/1971 | Mace | 116/215 |
| 3,839,825 | A | * | 10/1974 | Nica | 49/42 |
| 3,913,717 | A | * | 10/1975 | Collins | 49/46 |
| 4,408,406 | A | * | 10/1983 | Barton | 40/660 |
| 4,454,671 | A | * | 6/1984 | Morgenstern | 40/606.12 |
| 4,557,073 | A | * | 12/1985 | Sandling | 109/8 |
| 4,909,178 | A | * | 3/1990 | Le Brocq | 40/660 |
| 4,944,971 | A | | 7/1990 | McLaughlin | |
| 5,077,925 | A | | 1/1992 | Herrera et al. | |
| 5,168,600 | A | | 12/1992 | Huang | |
| 5,430,974 | A | * | 7/1995 | Hering | 40/660 |
| 5,477,633 | A | * | 12/1995 | Leinberger | 40/660 |
| 5,570,541 | A | * | 11/1996 | Hering | 49/47 |
| 5,598,652 | A | * | 2/1997 | Nurre | 49/660 |
| 5,657,886 | A | * | 8/1997 | Tacchella | 49/660 |
| 5,979,113 | A | * | 11/1999 | Hering | 49/47 |
| 6,212,809 | B1 | * | 4/2001 | Gaule | 40/660 |

FOREIGN PATENT DOCUMENTS

| | | |
|---|---|---|
| EP | 390 302 | 3/1990 |

* cited by examiner

*Primary Examiner*—Gregory J. Strimbu
(74) *Attorney, Agent, or Firm*—Allen, Dyer, Doppelt, Milbrath & Gilchrist, P.A.

(57) ABSTRACT

A method of advertising includes providing a transparent, tubular sleeve within which a sheet carrying advertising is placed and removably attaching the tubular sleeve to one of the arms of a turnstile.

11 Claims, 12 Drawing Sheets

METHOD OF DISPLAYING ADVERTISING ON A TURNSTILE

CROSS REFERENCE TO RELATED APPLICATION

This application is a continuation of and hereby incorporates by reference the disclosure of application Ser. No. 09/309,025, filed May 10, 1999 now abandoned, which itself is a continuation of application Ser. No. 08/740,879, filed Nov. 4, 1996, U.S. Pat. No. 5,979,113, which itself is a continuation-in-part of application Ser. No. 08/450,496 filed May 26, 1995, U.S. Pat. No. 5,570,541, which is a continuation-in-part of application Ser. No. 08/189,802 filed on Feb. 1, 1994, U.S. Pat. No. 5,430,974, all of which are commonly owned with the present invention.

BACKGROUND OF THE INVENTION

1. Field of the Invention

This invention relates to methods and devices for displaying indicia. More particularly, the present invention relates to advertising on turnstiles. In a further and more specific aspect, the present invention concerns a device apparatus containing visual information mounted on the arms of turnstile.

2. The Prior Art

Access to public as well as many private facilities is often controlled by devices conventionally referred to as turnstiles. Turnstiles consist of a housing placed in an accessway to define a narrow passageway. This passageway is controlled by an arm extending thereacross. In order to move through the passageway, the arm of the turnstile must be moved aside. Typically, turnstiles have a revolving plate mounted in the housing from which a number of arms extend. An individual moves into the arm presently blocking the passageway, and moves it down and away, rotating the rotating plate. The individual is now free to progress through the passageway, with a subsequent arm rotating up behind the individual to block the passageway from following individuals.

Turnstiles work well to control the flow of a crowd and/or charge and collect admission. However, they also use a large amount of space which could be used for other purposes. Specifically, at the present time, space is at a premium for advertisements. Advertisements generate a large volume of revenue in public event facilities, and are very much an integral portion of our society. Advertisements inform as well as entice individuals. High visibility locations in which to advertise are continually being sought, with prime location subject to a great deal of competition between advertisers.

Advertisements are presented in a wide variety of ways, the most common of which are placing posters in a case or simply tacking a poster to a wall. These are traditional and well established methods, however, these methods are limited by the amount of wall space available. Recently, Video monitors have been used to provide a plurality of ever changing advertisements. This method, while very effective, is also very expensive. Generally speaking, advertisements are prevalent throughout society, with most available space already allocated for advertisements. While there may be some space available, it is generally not highly desirable, being out of the way or less visible than preferred.

Turnstiles occupy a position which is highly trafficked, since everyone must pass through the turnstiles, and highly visible since most people look at the turnstile as they pass through. Conventional turnstiles, however, do not take advantage of their premier location, and while they perform their blocking functions admirably, take up advertising space, and more importantly, take peoples eyes off wall advertisements as they concentrate on passing the turnstile.

It would be highly advantageous, therefore, to remedy the foregoing and other deficiencies inherent in the prior art.

SUMMARY OF THE INVENTION

Accordingly, it is an object of the present invention to provide a new and improved turnstile.

Another object of the present invention is to provide an indicia device for use on a conventional turnstile.

And another object of the present invention is to provide a method of advertising on a turnstile.

Still another object of the present invention is to provide a relatively inexpensive and highly effective method of advertising.

Yet another object of the present invention is to provide a relatively inexpensive indicia device for use on turnstiles.

Yet still another object of the present invention is to provide an indicia device easily installable on substantially any turnstile apparatus.

A further object of the present invention is to provide an indicia device in which the indicia may be readily changed.

And a further object of the present invention is to provide an indicia device which can be readily attached without alteration to the turnstile and with conventional tools.

Yet a further object of the present invention is to provide an indicia device which can be constructed of conventional materials using conventional techniques.

And yet a further object of the present invention is to provide an indicia device which can be constructed in a variety of configurations to meet an individual users criteria.

Briefly, to achieve the desired objects of the present invention in accordance with a preferred embodiment thereof, provided is a turnstile comprising a housing, an arm rotatably carried by the housing, a cover removably affixed to the arm, and indicia carried by the cover. The arm extends into a passageway adjacent the housing and the indicia is positioned for viewing by persons moving through the passageway. The indicia device includes a tubular sleeve carrying the indicia which is receivable about the arm. The indicia device also includes coupling means for coupling the sleeve to the arm.

In a preferred embodiment, the cover comprises a transparent tubular sleeve. Further, a sheet having the indicia thereon is inserted within the tubular sleeve for viewing the indicia therethrough.

The coupling means includes a collar configured to adjustably and securely engage the arm and an attachment member for attaching the arm receiving end of the tubular sleeve to the collar. The collar includes an arm securing portion for coupling the collar to the arm, a sleeve securing portion for securing the tubular sleeve to the collar and a bore extending through the arm securing portion and the sleeve securing portion for receiving the arm.

BRIEF DESCRIPTION OF THE DRAWINGS

The foregoing and further and more specific objects and advantages of the instant invention will become readily apparent to those skilled in the art from the following detailed description of a preferred embodiment thereof, taken in conjunction with the drawings, in which.

DETAILED DESCRIPTION OF THE PREFERRED EMBODIMENT

Figure 1:
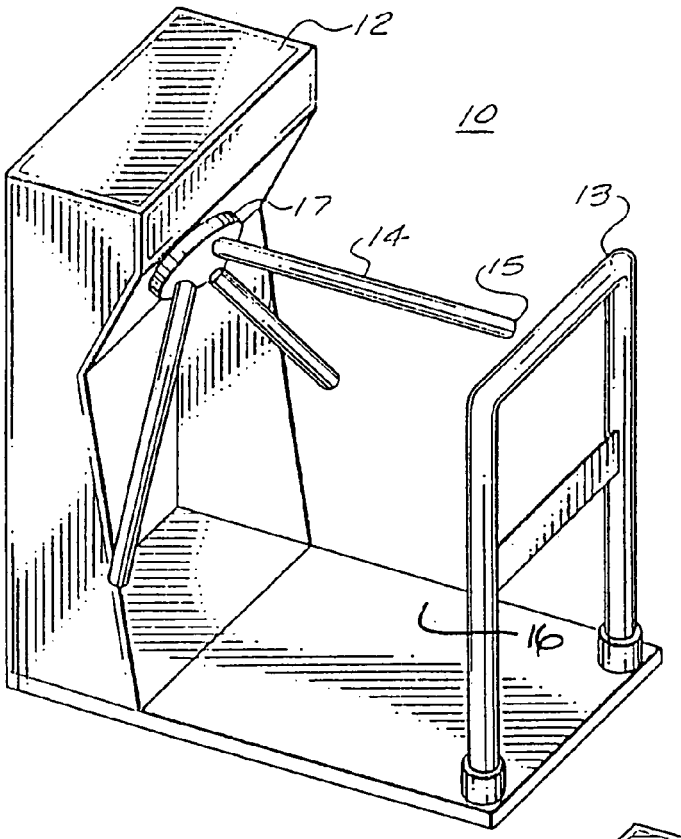
FIG. 1 is a perspective view illustrating a turnstile device.

Turning now to the drawings in which like reference characters indicate corresponding elements throughout the several views, attention is first directed to FIG. 1 which illustrates a turnstile device generally designated 10, consisting of a housing 12 opposed by an obstruction 13. Housing 12 and obstruction 13 define a passageway therebetween, alternately blocked by one of three arms 14, each having a free end 15. Arms 14 extend from a plate 17 rotatably mounted on housing 12 such that one of arms 14 extend across the passageway at any given time. As an individual moves through the passageway, the arm blocking the passageway is rotated out of the way allowing an individual to pass through. As the arm is moved, another arm rotates up behind the individual, again blocking the passageway.

Set forth for purposes of orientation and reference in connection with the ensuing detailed description of the preferred embodiment of the instant invention, the foregoing brief description of turnstile 10 is intended to be generally representative of typical, commercially available turnstiles. Details not specifically illustrated and described will be readily understood and appreciated by those skilled in the art.

Figure 2:
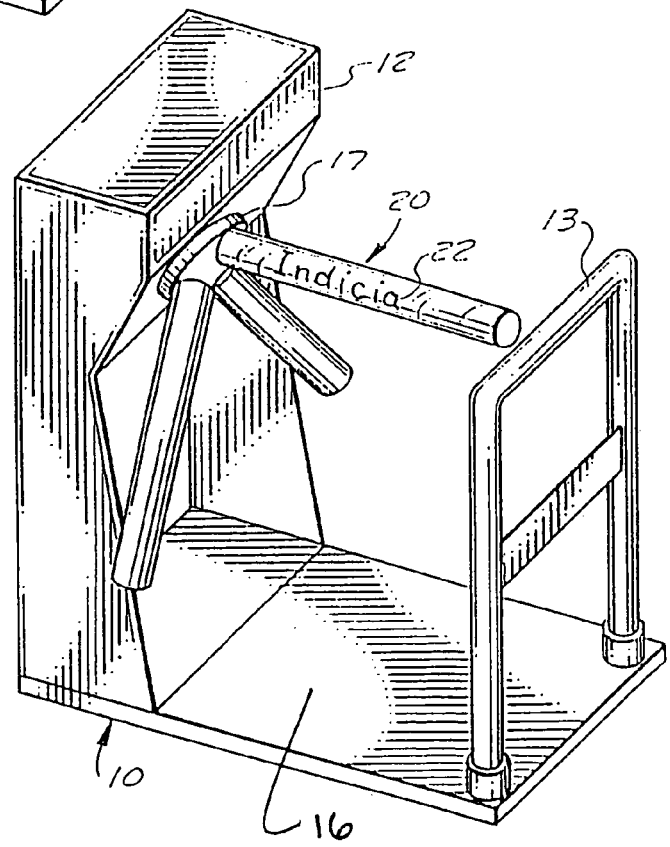
FIG. 2 is a perspective view illustrating an indicia device constructed in accordance with the teachings of the present invention as it would appear installed on the turnstile device of FIG. 1.

With reference to FIG. 2, turnstile 10 is illustrated with indicia devices, generally designated 20, installed on arms 14. Indicia device 20 encloses arm 14, and contains visual information or indicia 22. Indicia 22 is preferably positioned so as to be in proper orientation for viewing when arm 14 is in the blocking position. Identical or diverse indicia may be carried by individual indicia devices 20. If diverse indicia is employed between separate indicia device 20, each diverse indicia would be viewed as the appropriate arm rotates to the blocking position.

Still referring to FIG. 2, three separate indicia devices 20 are shown installed on three separate arms 14. One skilled in the art will understand that each arm need not be covered. Furthermore, a turnstile device may have more than three or less than three arms. One skilled in the art will understand that substantially any turnstile device having arms may be improved by the installation of one or more indicia devices 20.

Figure 3:
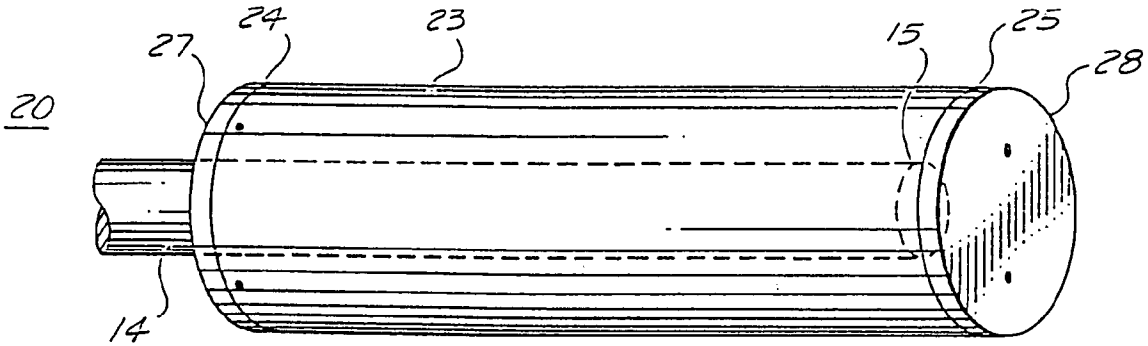
FIG. 3 is an isometric view of the indicia device of FIG. 2.

Indicia device 20 is a generally tubular sleeve configured to fit over and enclose arm 14 as can be seen in FIG. 3. Indicia device 20 consists of a tubular sleeve 23 having an arm receiving end 24 and a free end 25. Arm receiving end 24 is closed by a collar 27 configured to receive arm 14 therethrough, and free end 25 is closed by an end cap 28. With additional reference to FIG. 4, collar 27 includes a sleeve securing portion having an outer portion 29 and an inner portion 30, and an arm securing portion 32. Outer portion 29 has a diameter substantially equivalent to the diameter of an outer surface 33 of tubular sleeve 23 and engages arm receiving end 24. Inner portion 30 has a diameter substantially equivalent to the diameter of an inner surface 34 of tubular sleeve 23, and is received in tubular sleeve 23 at arm receiving end 24. A groove 35 is circumscribed around the periphery of intermediate member 30 and contains a seal ring 37 which engages inner surface 34 sealing tubular sleeve 23. This is to prevent moisture or other detrimental materials from entering tubular sleeve 23 and damaging indicia 22. Arm securing portion 32 extends into arm receiving end 24 and has a diameter less than the diameter of inner surface 34 and therefore is spaced from inner surface 34. A bore 38 is formed centrally through collar 27, extending through outer portion 29, inner portion 30, and arm securing portion 32. Bore 38 has a diameter sufficient to receive arm 14 therethrough. Set screws 39 extend through arm securing portion 32, into bore 38 and engage arm 14, securely fixing collar 27 to arm 14. In this specific embodiment, two set screws are employed separated by approximately 90 degrees. Threaded holes 40 are formed around the outer edge of inner portion 30, and align with corresponding holes 42 formed through tubular sleeve 23 proximate arm receiving end 24. Screws (not shown) extend through holes 42 and thread into threaded holes 40, securely holding tubular sleeve 23 onto collar 27 and thereby, onto arm 14.

Figure 4:
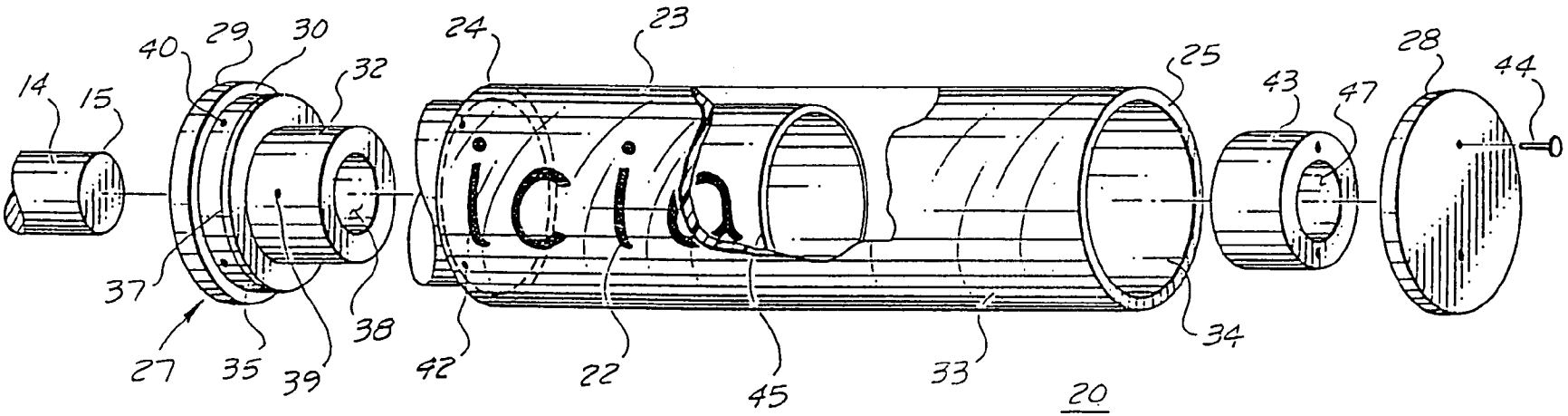
FIG. 4 is an exploded view of the indicia device of FIGS. 2 and 3.

Still referring to FIG. 4, end cap 28 has a diameter substantially equivalent to outer surface 33 of tubular sleeve 23 and is fixed to free end 25. In this embodiment, end cap 28 is bonded to free end 25 using an adhesive, but substantially any method may be employed to securely attach end cap 28 to free end 25. A spacer 43 is coupled centrally to the inside of end cap 28 and is configured to extend into tubular sleeve 23 at free end 25. Spacer 43 is coupled to end cap 28 by attachment members, such as screws 44, extending through end cap 28 into spacer 43. One skilled in the art will appreciate that an adhesive or other attachment means may be used to fix spacer 43 to end cap 28. Spacer 43 is positioned centrally within tubular sleeve 23 at free end 25, and has a diameter less than the diameter of inner surface 34, thereby creating a space between spacer 43 and inner surface 34. A sheet 45 of material carrying indicia 22 is rolled into a tube with indicia 22 visible on the outer surface thereof, and inserted into tubular sleeve 23. When properly positioned, sheet 45 preferably extends from collar 27 to end cap 28, with its outer surface pressing against inner surface 34. It will be understood that a shorter sheet may be inserted which would not extend from collar 27 to end cap 28, however this is not preferred since this would permit viewing of the interior of tubular sleeve 23.

Tubular sleeve 23 is preferably constructed of a transparent material, through which indicia 22 is visible. Substantially any clear material may be employed for tubular sleeve 23, however, it must be strong enough to withstand repeated contact by individuals passing through the passageway. The preferred material for tubular sleeve 23 is a cast acrylic, an extruded acrylic or polycarbonate. One skilled in the art will understand that while a transparent tubular sleeve 23 containing a sheet 45 is preferred, a tubular sleeve may be employed having indicia directly thereon. Collar 27, and spacer 43, may be constructed of substantially any material, such as metal or plastic. Aluminum is one preferred material. Others include nylon, polyvinylchloride, and Delrin. End cap 28 may be the same materials, but for purely aesthetic reasons polycarbonate is preferred, since it can be produced in a variety of color options.

Indicia device 20 is easily installed on arm 14 of turnstile 10 without altering the turnstile and without using specialized tools, by first sliding collar 27 onto arm 14 such that arm extends through bore 38. Set screws 39 are tightened, engaging arm 14 and securing collar 27 thereto. Sheet 45, containing indicia 22, is rolled and inserted into tubular sleeve 23 in the proper orientation. Sheet 45 may be formed of substantially any material which can be rolled, and onto which indicia can be placed, such as paper, plastic, photographic paper, metal foils etc. Tubular sleeve 23 containing sheet 45 is received about arm 14 and coupled to collar 27 by inserting screws (not shown) through holes 42 into threaded holes 40. Due to the length of tubular sleeve 23, in order to insure spacing of free end 25 from arm 14, and to stabilize it for contact with individuals passing through the passageway, spacer 43 includes a bore 47 extending therethrough which receives free end 15 of arm 14, thereby positioning and securing free end 25. In this manner, indicia 22 is visible through and protected by tubular sleeve 23. Furthermore, sheet 45 may be easily changed by removing tubular sleeve 23 from collar 27 and replacing sheet 45.

Figure 5:
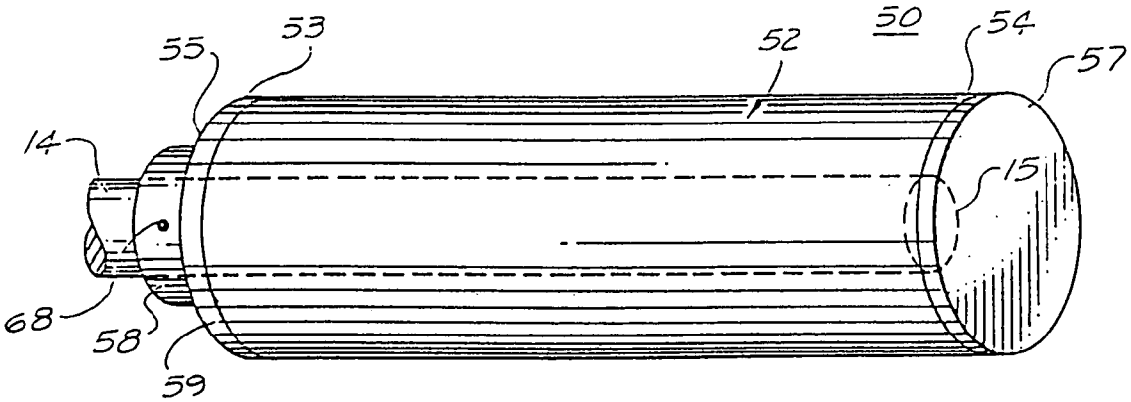
FIG. 5 is an isometric view of an alternate embodiment of an indicia device.
Figure 6:
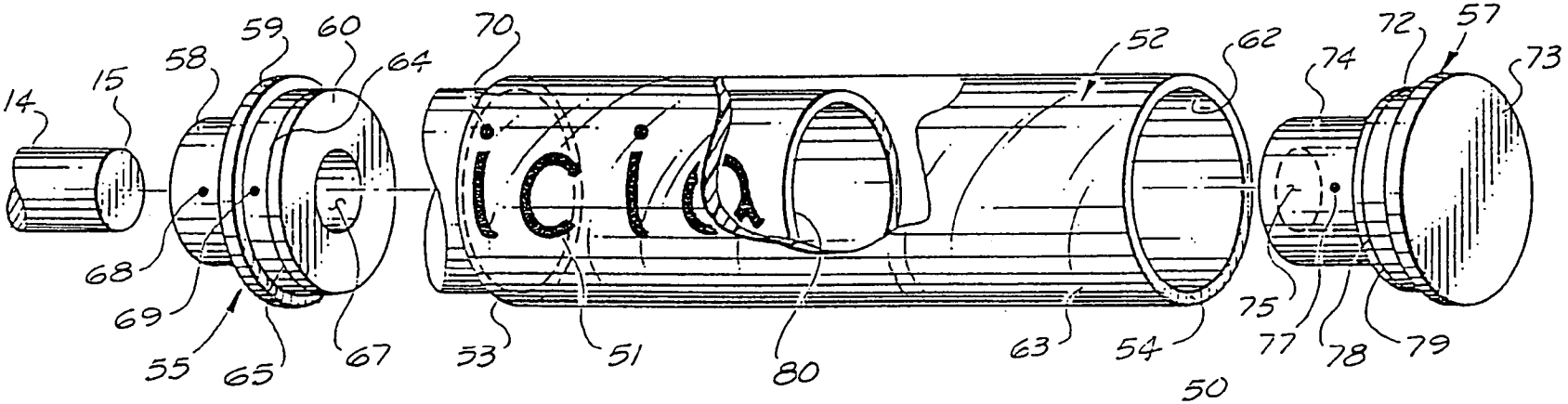
FIG. 6 is an exploded view of the indicia device of FIG. 5.

Reference is now made to FIGS. 5 and 6 which illustrate an alternate embodiment of an indicia device incorporating the teachings of the present invention and generally designated by the reference character 50. Indicia device 50 is generally similar to previously described embodiment 20 and is similarly configured to fit over and enclose arm 14 to display indicia 51. Indicia device 50 consists of a tubular sleeve 52 having an arm receiving end 53 and a free end 54. Arm receiving end 53 is closed by a collar 55 configured to receive arm 14 therethrough, and free end 54 is closed by an end cap 57.

With additional reference to FIG. 6, collar 55 includes an arm securing portion 58 and a sleeve securing portion having an outer portion 59, and an inner portion 60. Inner portion 60 has a diameter substantially equivalent to the diameter of an inner surface 62 of tubular sleeve 52, and is received in tubular sleeve 52 at arm receiving end 53. Outer portion 59 has a diameter substantially equivalent to the diameter of an outer surface 63 of tubular sleeve 52 and engages arm receiving end 53. A groove 64 is circumscribed around the periphery of inner portion 60 and contains a seal ring 65 which engages inner surface 62 sealing tubular sleeve 52. As with the previous embodiment, this is to prevent moisture or other detrimental materials from entering tubular sleeve 52 and damaging indicia 51.

Arm securing portion 58 has a diameter less than the diameter of inner surface 62 and extends outward from outer member 59, away from tubular sleeve 52. A bore 67 is formed centrally through collar 55, extending through arm securing portion 58, outer portion 59, and inner portion 60. Bore 67 has a diameter sufficient to receive arm 14 therethrough. Set screws 68 extend through arm securing portion 58, into bore 67 and engage arm 14, securely fixing collar 55 to arm 14. In this immediate embodiment, two set screws are employed separated by approximately 90 degrees. Threaded holes 69 are formed around the outer edge of inner portion 60 and align with corresponding holes 70 formed through tubular sleeve 52 at arm receiving end 53. Screws (not shown) extend through holes 70 and thread into threaded holes 69, securely holding tubular sleeve 52 onto collar 55 and thereby, onto arm 14.

Still referring to FIG. 6, end cap 57 includes an inner portion 72 having a diameter substantially equivalent to the diameter of inner surface 62 and an outer portion 73 having a diameter substantially equivalent to the diameter of outer surface 63. A spacer 74 may be formed integrally with or secured to inner portion 72 and is positioned centrally within tubular sleeve 52 at free end 54. Spacer 74 has a diameter less than the diameter of inner surface 62, thereby creating a space between spacer 74 and inner surface 62. A bore 75 extends through spacer 74 terminating at end cap 57. Bore 75 has a diameter sufficient to receive free end 15 of arm 14 therein. Set screws 77 extend through spacer 74 into bore 75 and engage arm 14, securely fixing spacer 74 to arm 14. In this specific embodiment, two set screws are employed separated by approximately 90 degrees.

In this embodiment, inner portion 72 of end cap 57 is received within free end 54 and has a groove 78 circumscribed about its periphery. Groove 78 contains a seal ring 79 which engages inner surface 62 sealing tubular sleeve 52. As with the previous embodiment, a sheet 80 of material carrying indicia 51 is rolled into a tube with the indicia visible on the outer surface thereof, and inserted into tubular sleeve 52. When properly positioned, sheet 80 preferably extends from collar 55 to end cap 57, with its outer surface pressing against inner surface 62. It will be understood that a shorter sheet may be inserted which would not extend from collar 55 to end cap 57, however this is not preferred since this would permit viewing of the interior of tubular sleeve 52.

Indicia device 50 is easily installed on arm 14 of turnstile 10 without altering the turnstile and without using specialized tools, by first sliding collar 55 onto arm 14 such that arm 14 extends through bore 67. Sheet 80 of material containing indicia 51 is rolled and inserted into tubular sleeve 52 in the proper orientation. Sheet 80 may be formed of substantially any material which can be rolled, and onto which indicia can be placed, such as paper, plastic, photographic paper, metal foils etc. Tubular sleeve 52 containing sheet 80 is received about arm 14 and coupled to collar 55 by inserting screws (not shown) through holes 70 into threaded holes 69. Spacer 74 and end cap 57 are then positioned with free end 15 of arm 14 received within spacer 74. Set screws 77 are tightened, engaging free end 15 and securing end cap 57 to arm 14. Tubular sleeve 52 is moved outward, towards end cap 57 until outer portion 58 engages free end 54 of tubular sleeve 52. Collar 55 is moved outward toward end cap 57, until outer portion 59 engages arm receiving end 53 of tubular sleeve 52. Set screws 68 are tightened, engaging arm 14 and securing collar 55 thereto. In this manner, tubular sleeve 52 is securely retained between collar 55 and end cap 57 and indicia 51 is visible through and protected by tubular sleeve 52. Furthermore, sheet 80 may be easily changed.

Figure 7:
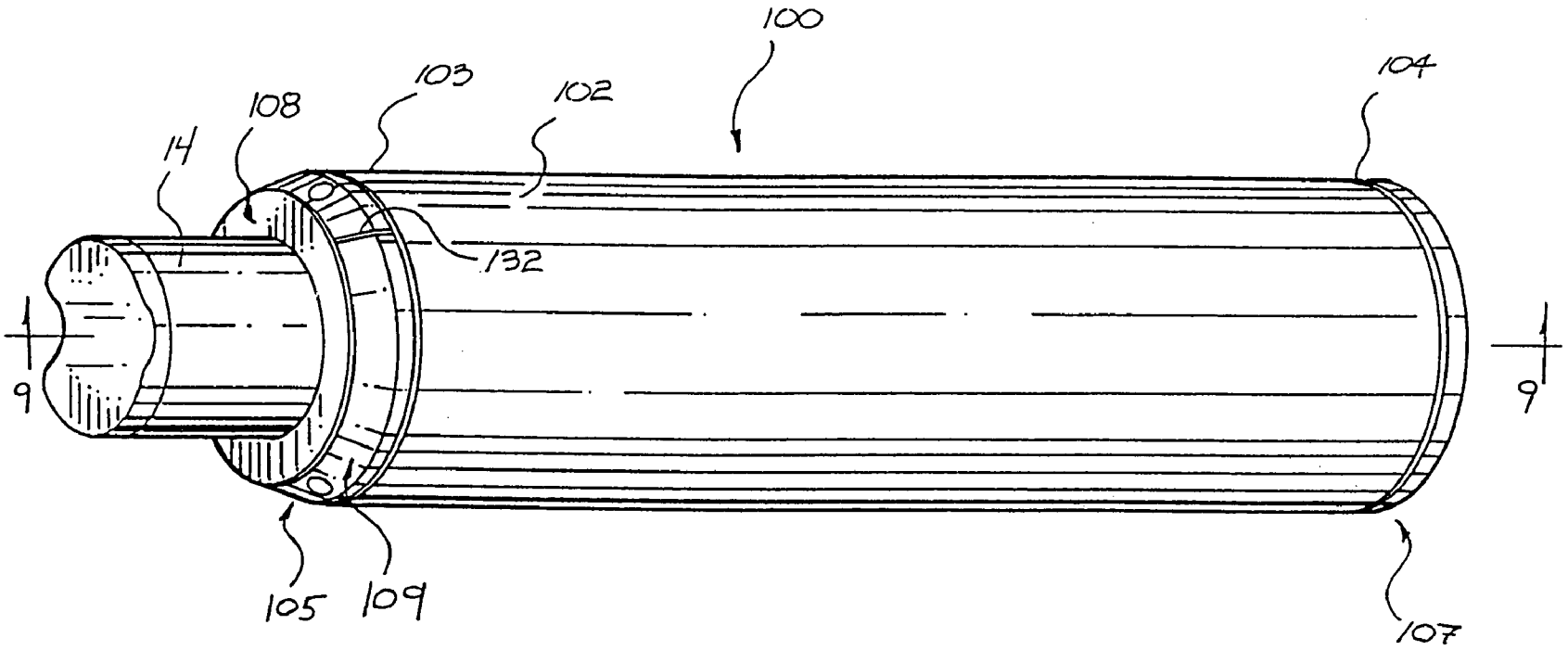
FIG. 7 is an isometric view of another embodiment of an indicia device constructed in accordance with the teachings of the present invention.

Referring now to FIG. 7 another embodiment of an indicia device incorporating the teachings of the present invention and generally designated by the reference character 100, is illustrated. Indicia device 100 is generally similar to previously described embodiments and is similarly configured to fit over and enclose arm 14 to display indicia. Indicia device 100 includes a tubular sleeve 102 having an arm receiving end 103 and a free end 104. Tubular sleeve 102 is configured to contain indicia as with previously disclosed embodiments. Arm receiving end 103 is closed by a collar 105 configured to receive arm 14 therethrough, and free end 104 is closed by a collar 107. Collars 105 and 107 engage arm 14 and securely retain tubular sleeve 102 therebetween.

Figure 8:
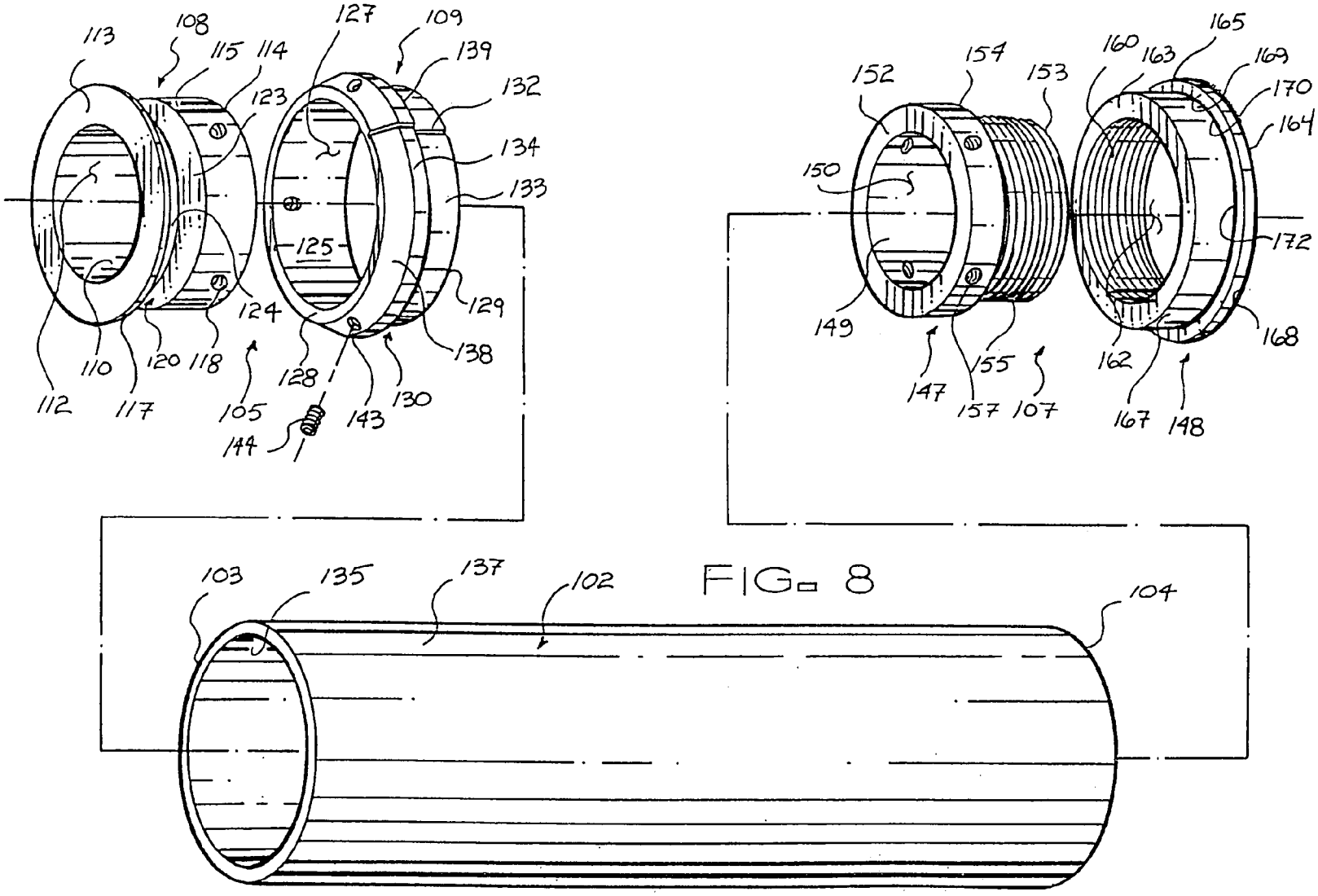
FIG. 8 is an exploded view of the indicia device of FIG. 7.
Figure 9:
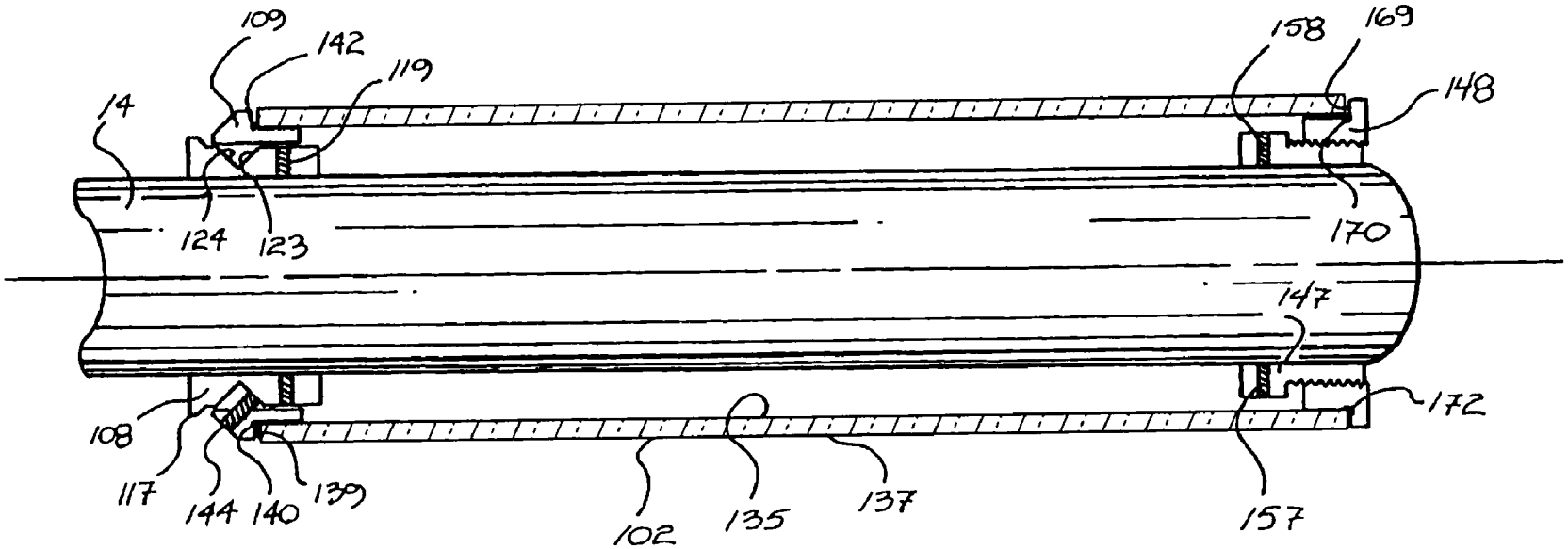
FIG. 9 is a partial sectional view taken along line 9—9 of FIG. 7.

With additional reference to FIGS. 8 and 9, collar 105 includes an arm securing portion 108 and a sleeve securing portion 109. Arm securing portion 108 is generally cylindrical with an inner surface 110 defining a bore 112 extending from an end 113 to an end 114, and an outer surface 115. Bore 112 has a diameter sized to receive arm 14. Arm securing portion 108 also includes stop means consisting of a radially outwardly projecting lip 117 at end 113, the purpose of which will be described subsequently. Threaded holes 118 are formed proximate end 114, and extend inwardly from outer surface 115 to inner surface 110, communicating with bore 112. As can be seen with specific reference to FIG. 9, set screws 119 extend through threaded holes 118 spaced about the circumference of arm securing portion 108, and engage arm 114. In this specific embodiment, four set screws 119 (not all shown) are employed, separated by approximately 45 degrees. A groove 120 is formed in outer surface 115 around the periphery of arm securing portion 108 intermediate ends 113 and 114. Groove 120 has a generally "V" shaped profile and is formed by walls 122 and 123 sloping inward from surface at a 45 degree angle to meet at the bottom.

Sleeve securing portion 109 is generally cylindrical with an inner surface 125 defining a bore 127 extending from and end 128 to an end 129, an outer surface 130, and a split 132 extending from end 128 to end 129 and radially inward from outer surface 130 to inner surface 125. Bore 127 has a diameter sized to receive arm securing portion 108 therein. Outer surface 130 has an inner portion 133 adjacent end 129 and an outer portion 134 adjacent end 128. Inner portion 133 has a diameter less than the diameter of an inner surface 135 of tubular sleeve 102, and is received in tubular sleeve 102 at arm receiving end 103. Outer portion 134 has a diameter substantially equivalent to the diameter of an outer surface 137 of tubular sleeve 102 and abuts arm receiving end 103. Outer portion 134 includes a beveled surface 138 adjacent end 128, sloping inward at an angle such that beveled surface 138 is parallel to wall 123 of groove 120, as can be seen in FIG. 9. In this instance beveled surface 138 slopes at a 45 degree angle. A shoulder 139 is formed between outer portion 134 and inner portion 133 due to the difference in their respective diameters. A groove 140 is circumscribed around the periphery of collar 105 at the junction between outer portion 134 and inner portion 133 and contains a ring seal 142 which engages inner surface 135 at arm receiving end 103, sealing arm receiving end 103 of tubular sleeve 102. Ring seal 142 prevents moisture or other detrimental materials from entering tubular sleeve 102 and damaging indicia contained therein.

Threaded holes 143 are formed around outer portion 134, extending from beveled surface 138 to bore 127. Threaded holes 143 are slanted at a 45 degree angle corresponding to the angle of beveled surface 138. Preferably, three set screws 144 with corresponding threaded holes 143 are evenly spaced around outer portion 134. Sleeve securing portion 109 is received about arm securing portion 108, with end 128 abutting lip 117. While lip 117 retains sleeve securing portion 109, one skilled in the art will understand that set screws 144 are sufficient to secure sleeve securing portion 109 in position about arm securing portion 108. When sleeve securing portion 109 is properly positioned, set screws 144 extend through threaded holes 143 and engage wall 123. As set screws 144 are tightened, they act as a wedge, widening or narrowing split 132, resulting in a corresponding increase or decrease in the diameter of inner portion 133. The increased diameter of inner portion 133 securely holds tubular sleeve 102 onto collar 105 and thereby, onto arm 14.

Still referring to FIGS. 8 and 9, collar 107 includes an arm securing portion 148. Arm securing portion 147 is generally cylindrical with an inner surface 149 defining a bore 150 extending from an end 152 to an end 153, and an outer surface having a threaded portion 155 proximate end 153. Bore 150 has a diameter sized to receive arm 114. Threaded holes 157 are formed proximate end 152, and extend inward from outer surface 154 to inner surface 149, communicating with bore 150. As can be seen with specific reference to FIG. 9, set screws 158 extend through threaded holes 157 spaced about the circumference of arm securing portion 147, and engage arm 14. In this specific embodiment, four set screws 158 (not all visible) are employed, separated by approximately 45 degrees.

Sleeve securing portion 148 is generally cylindrical with an inner surface 160 defining a threaded bore 162 extending from an end 163 to an end 164, and an outer surface 165. Threaded bore 162 has a diameter sized to receive end 153 of arm securing portion 147 and threadably engage threaded portion 155. Outer surface 165 has an inner portion 167 adjacent end 163 and an outer portion 168 adjacent end 164. Inner portion 167 has a diameter less than the diameter of inner surface 135 of tubular sleeve 102, and is positioned in tubular sleeve 102 at free end 104. Outer portion 168 has a diameter substantially equivalent to the diameter of outer surface 137 of tubular sleeve 102 and abuts free end 104. A shoulder 169 is formed between outer portion 168 and inner portion 167 due to the difference in their respective diameters. A groove 179 is circumscribed around the periphery of collar 107 at the junction between outer portion 168 and inner portion 167 and contains a ring seal 172 which engages inner surface 135 at free end 104, sealing free end 104 of tubular sleeve 102. As sleeve securing portion 148 is threaded onto end 153 of arm securing portion 147, tubular sleeve 102 is compressed between shoulder 139 and shoulder 169, securely holding tubular sleeve 102 in position.

Indicia device 100 is easily installed on arm 14 of turnstile 10 without altering the turnstile and without using specialized tools, by first sliding collar 105 onto arm 14 such that arm 14 extends concurrently through bores 1.12 and 127. Set screws 119 are tightened, engaging arm 14 and securing arm securing portion 108 thereto. Indicia is inserted into tubular sleeve 102 in the proper orientation, as described previously. Tubular sleeve 102 containing indicia (not shown) is received about arm 14 with end 103 abutting shoulder 139. Screws 144 are tightened, expanding sleeve securing portion 109 such that end 103 of tubular sleeve 102 is tightly engaged. Collar 107 is received about free end 15 or arm 14. Screws 158 are tightened, securing arm securing portion 147 to arm 14. Sleeve securing portion 148 is then received by arm 14 and threaded onto threaded portion 155, thereby positioning and supporting tubular sleeve 102.

Figure 10:
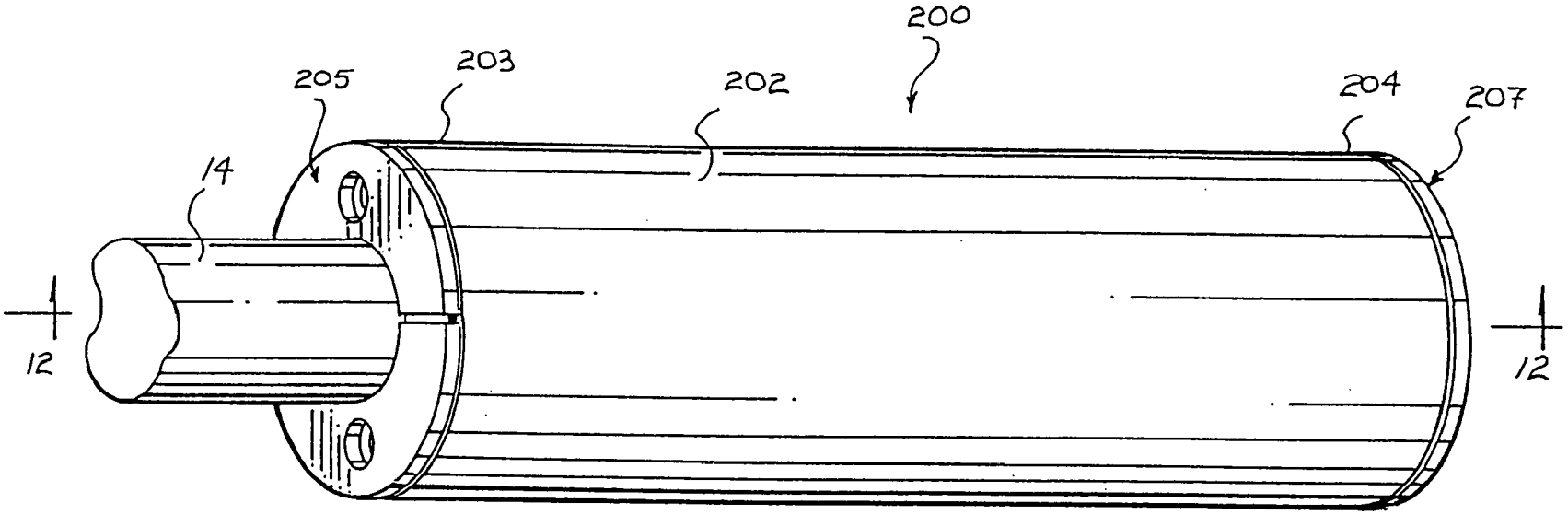
FIG. 10 is an isometric view of another embodiment of an indicia device constructed in accordance with the teachings of the present invention.

Turning now to FIG. 10, another embodiment of an indicia device, generally designated 200, for use on turnstile 10 and to be received by arms 14, is illustrated. Indicia device 200 is substantially similar to indicia device 100, including a tubular sleeve 202 having an arm receiving end 203 and a free end 204, configured to contain indicia, a collar 205 configured to receive arm 14 therethrough and secure arm receiving end 203, and a collar 207 securing free end 204. Collars 205 and 207 engage arm 14 and securely retain tubular sleeve 202 therebetween.

Figure 11:
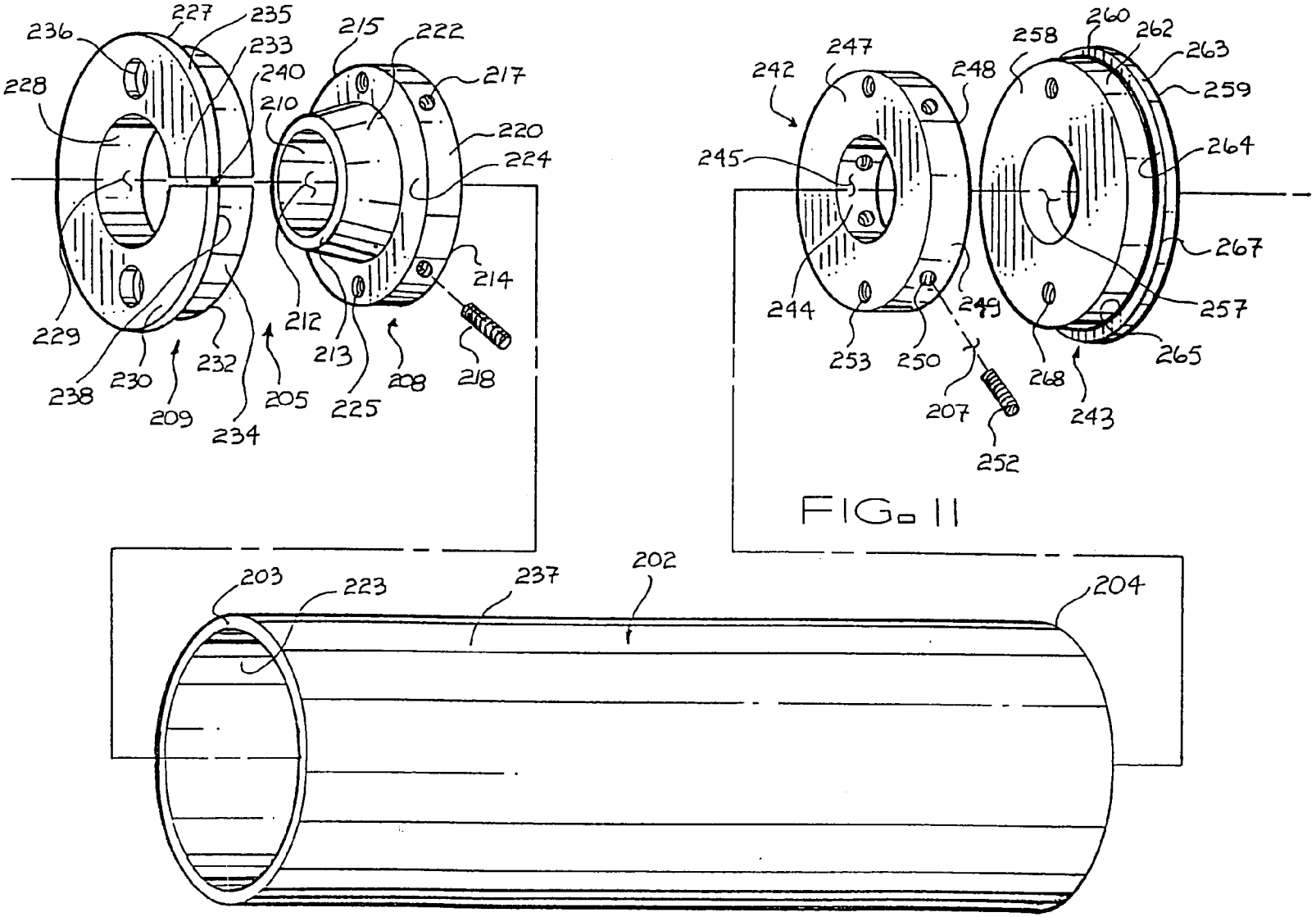
FIG. 11 is an exploded view of the indicia device of FIG. 10.
Figure 12:
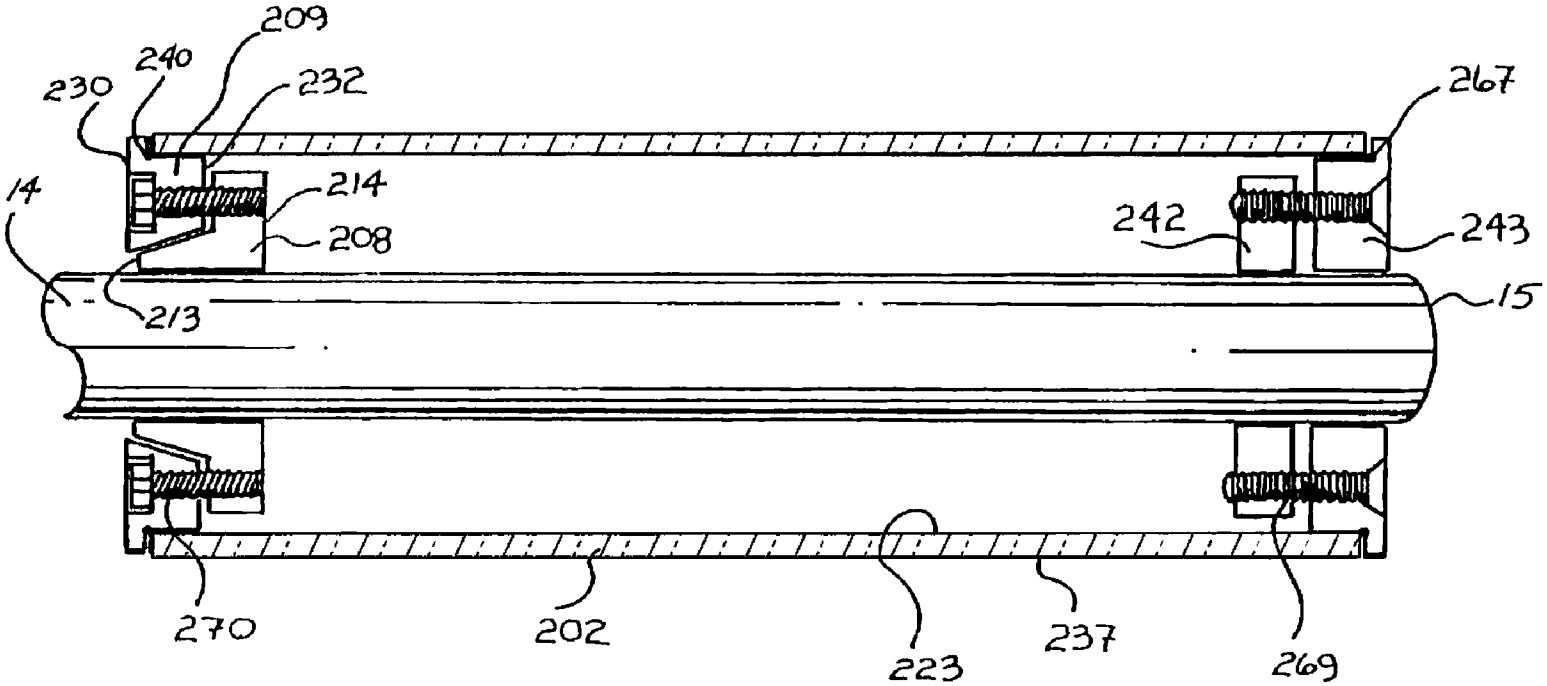
FIG. 12 is a sectional view taken along line 12—12 of FIG. 11.

With reference to FIGS. 11 and 12, collar 205 includes an arm securing portion 208 and a sleeve securing portion 209. Arm securing portion 208 is generally cylindrical with an inner surface 210 defining a bore 212 extending from an end 213 to an end 214, and an outer surface 215. Bore 212 has a diameter sized to receive arm 14. Threaded holes 217 are formed proximate end 214, and extend inward from outer surface 215 to inner surface 212, communicating with bore 212. Set screws 218 extend through threaded holes 217 spaced about the circumference of arm securing portion 208, and engage arm 14. In this specific embodiment, four set screws 218 (not all visible) are employed, separated by approximately 45 degrees.

Outer surface 215 has an inner portion 220 adjacent end 214 and an outer portion 222 adjacent end 213. Inner portion 220 has a diameter less than the diameter of an inner surface 223 of tubular sleeve 202, and is received in tubular sleeve 202 at arm receiving end 203. Outer portion 222 has a diameter less than the diameter of inner portion 220 and slopes inward, in the direction of bore 212, toward end 213. A shoulder 224 is formed between inner portion 220 and outer portion 222 due to the difference in their respective diameters. A pair of opposing threaded holes 225 are formed into shoulder 224 parallel to bore 212, the purpose for which will be described presently.

Sleeve securing portion 209 is generally cylindrical with an outer surface 227 and an inner surface 228 defining a bore 229 extending from an end 230 to an end 232 and having a diameter greater than arm 14 at end 230 and expanding toward end 232. Bore 229 is sized such that its diameter intermediate ends 230 and 232 is equal to the diameter of outer portion 222 at end 213. A split 233 is formed through a side of sleeve securing portion 209, extending from end 230 to end 232 and outer surface 227 to inner surface 228. Outer surface 227 has an inner portion 234 adjacent end 232 and an outer portion 235 adjacent end 230. Inner portion 234 has a diameter less than the diameter of an inner surface 223 of tubular sleeve 202, and is received in tubular sleeve 202 at free end 203. Outer portion 235 has a diameter substantially equivalent to the diameter of an outer surface 237 of tubular sleeve 202 and abuts free end 203. A shoulder 238 is formed between outer portion 235 and inner portion 234 due to the difference in their respective diameters. A counter sunk opening 236 is formed through sleeve securing portion 209, extending from end 230 to end 232. A groove 239 is circumscribed around the periphery of sleeve securing portion 209 at the junction between outer portion 235 and inner portion 234 and contains a ring seal 240 which engages inner surface at arm receiving end 203, sealing arm receiving end 203 of tubular sleeve 202.

Still referring to FIGS. 11 and 12, collar 207 includes an arm securing portion 242 and a sleeve securing portion 243. Arm securing portion 242 is generally cylindrical with an inner surface 244 defining a bore 245 extending from an end 247 to an end 248, and an outer surface 249. Bore 245 has a diameter sized to receive arm 14. Threaded holes 250 are from outer surface 249 to inner surface 244, communicating with bore 245. Set Screws 252 extend through threaded holes 250 spaced about the circumference of arm securing portion 242, and engage arm 14. In this specific embodiment, four set screws 252 are employed, separated by approximately 45 degrees. Additional threaded holes 253 are formed through arm securing portion 242 from end 247 to end 248, parallel to bore 245.

Sleeve securing portion 243 is positioned adjacent end 248 of arm securing portion 242, and is generally cylindrical with an inner surface 255 defining a bore 257 extending from an end 258 to an end 259, and an outer surface 260. Bore 257 has a diameter sized to receive free end 15 of arm 14. Outer surface 260 has an inner portion 262 adjacent end 258 and an outer portion 263 adjacent end 259. Inner portion 262 has a diameter less than the diameter of inner surface 223 of tubular sleeve 202, and is received in tubular sleeve 202 at free end 204. Outer portion 262 has a diameter substantially equivalent to the diameter of outer surface 237 of tubular sleeve 202 and abuts free end 204. A shoulder 264 is formed between outer portion 263 and inner portion 262 due to the difference in their respective diameters. A groove 265 is circumscribed around the periphery of sleeve securing portion 243 at the function between outer portion 263 and inner portion 262 and contains a ring seal 267 which engages inner surface 223 at free end 204, sealing free end 204 of tubular sleeve 202.

Sleeve securing portion 243 also includes threaded holes 268 extending from end 258 to end 259 parallel to bore 257. Screws 269 extend concurrently through threaded holes 268 and threaded holes 253.

Indicia device 200 is easily installed on arm 14 of turnstile 10 without altering the turnstile and without using specialized tools, by first sliding collar 205 onto arm 14 such that arm 14 extends concurrently through bores 229 and 212. Set screws 218 are tightened, engaging arm 14 and securing arm securing portion 208 thereto. Sleeve securing portion 209 is positioned adjacent arm securing portion 208, with end 213 received within bore 229. Tubular sleeve 202 is positioned enclosing arm securing portion 208, with end 203 abutting shoulder 238. Screws 270 are inserted through holes 236 into holes 225 and tightened. As screws 270 are tightened, outer portion 222 of outer surface 215 is drawn toward end 230 of sleeve securing portion 209. The interaction of inner surface 215, acts as wedge, widening or narrowing split 233, resulting in a corresponding increase or decrease in the diameter of inner portion 234. The increased diameter of inner portion 234 securely holds tubular sleeve 202 onto collar 205 and thereby, onto arm 14.

Collar 207 is then received about free end 15 of arm 14. When screws 269 are tightened, sleeve securing portion 243 is drawn toward arm securing portion 242, compressing tubular sleeve 202 between shoulder 238 and shoulder 264, securely holding tubular sleeve 202 in position.

Figure 13:
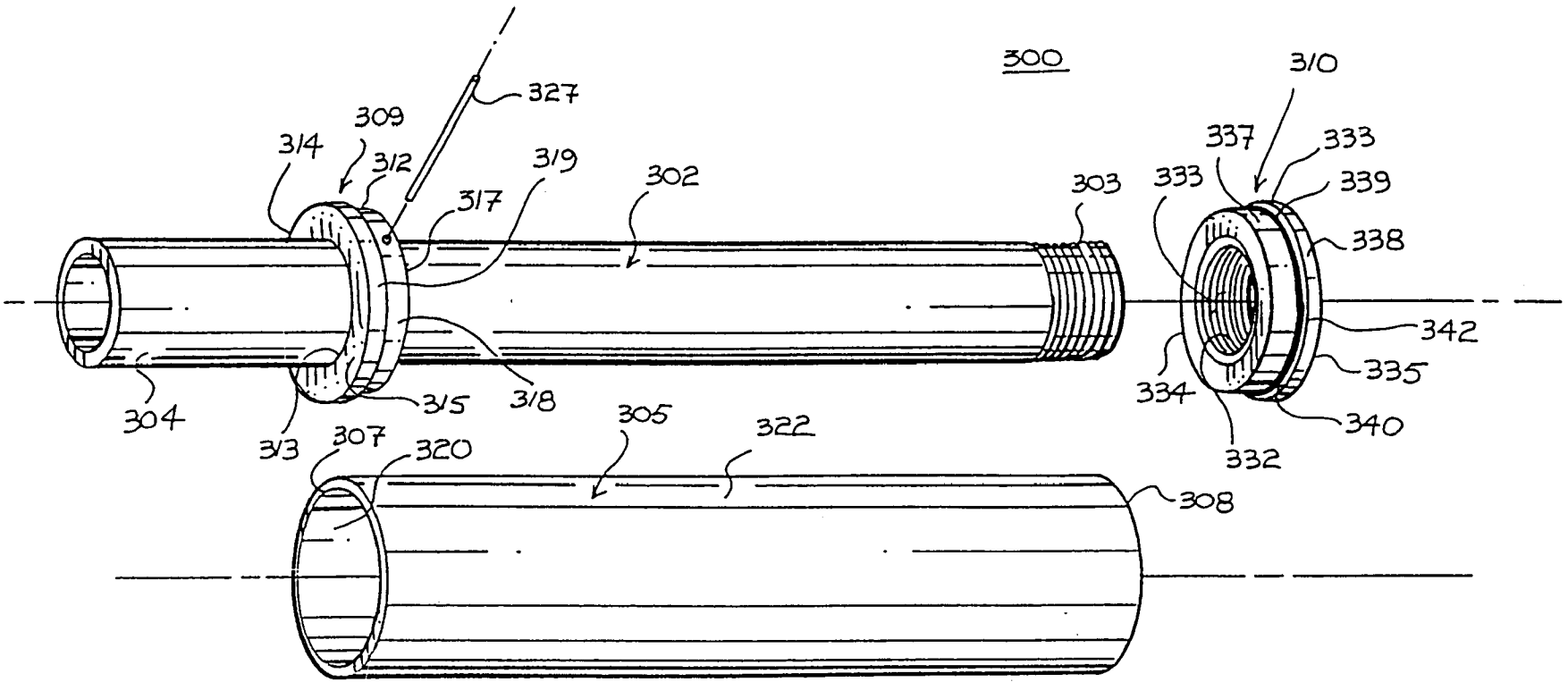
FIG. 13 is an exploded view of another embodiment of an indicia device constructed in accordance with the teachings of the present invention.
Figure 14:
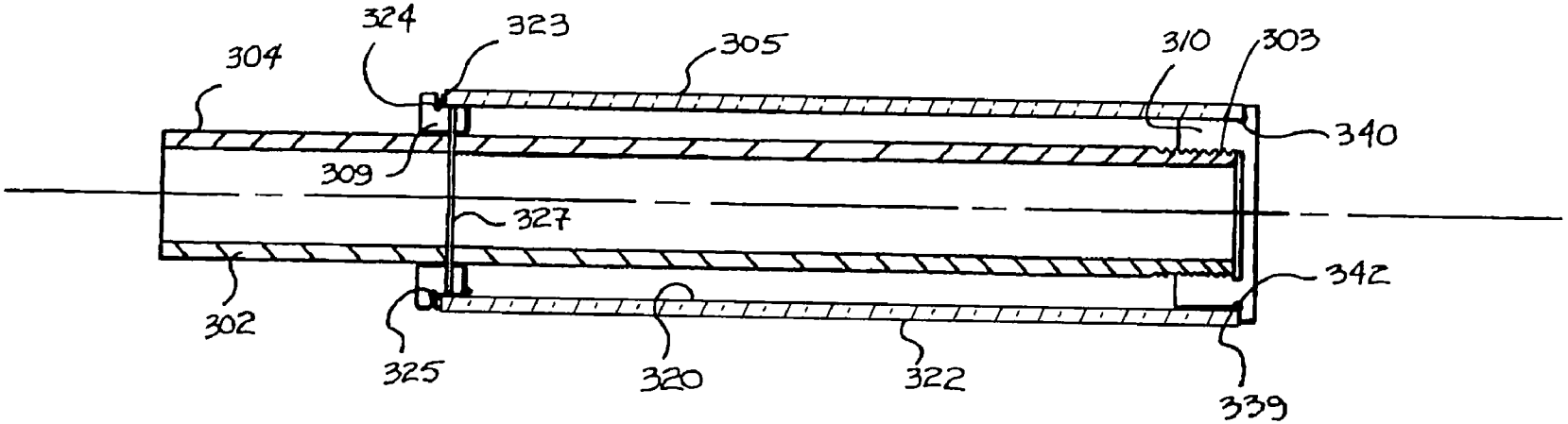
FIG. 14 is a sectional view of the indicia device of FIG. 13.

Turning now to FIGS. 13 and 14, another embodiment of an indicia device, generally designated 300, for use on turnstile 10, is illustrated. Indicia device 300 differs from the preceding embodiments in that it includes a replacement arm 302. Arm 302 includes a threaded end 303 and an end 304 adapted to be coupled to conventional turnstiles. Coupling means for coupling arm 302 to a turnstile is not specifically illustrated as conventional means, well known to those skilled in the art, are employed.

In similarity with previous embodiments, indicia device also includes a tubular sleeve 305 having an arm receiving end 207 and a free end 208, configured to contain indicia, a collar 309 fixed to arm 302 proximate end 304, and a collar 310 coupled to threaded end 303. Collar 309 is generally cylindrical with an outer surface 312 and an inner surface 313 defining a bore 314 extending from an end 315 to and end 317. Bore 314 has a diameter sized to receive arm 302. Outer surface 312 has an inner portion 318 adjacent end 317 and an outer portion 319 adjacent end 315. Inner portion 318 has a diameter less than the diameter of an inner surface 320 of tubular sleeve 305, and is received in tubular sleeve 305 at arm receiving end 307. Outer portion 319 has a diameter substantially equivalent to the diameter of an outer surface 322 of tubular sleeve 305 and abuts arm receiving end 307. A shoulder 323 is formed between outer portion 319 and inner portion 318 due to the difference in their respective diameters. A groove 324 is circumscribed around the periphery of collar 309 at the junction between outer portion 319 and inner portion 318 and contains a ring seal 325 which engages inner surface 320 at arm receiving end 307, sealing arm receiving end 307 of tubular sleeve 302. Collar 309 may be attached to arm 302 in many ways, such as welding, use of adhesives, or mechanical means such as a friction pin 327 extending concurrently through inner portion 318, arm 302, and back into inner portion 318.

Collar 310 generally cylindrical with an outer surface 330 and an inner surface 332 defining a threaded bore 333 extending from an end 334 to an end 335. Bore 314 has a diameter sized to receive arm 302. Outer surface 312 had an inner portion 337 adjacent end 334 and an outer portion 338 adjacent end 335. Inner portion 337 has a diameter less than the diameter of inner surface 320 of tubular sleeve 305, and is received in tubular sleeve 305 at free end 308. Outer portion 338 has a diameter substantially equivalent to the diameter of outer surface 322 of tubular sleeve 305 and abuts free end 308. A shoulder 339 is formed between outer portion 338 and inner portion 337 due to the difference in their respective diameters. A groove 340 is circumscribed around the periphery of collar 310 at the junction between outer portion 338 and inner portion 337 and contains a ring seal 342 which engages inner surface 320 at free end 308, sealing free end 308 of tubular sleeve 302. Collar is threaded onto threaded end 303, compressing and securing tubular sleeve 305 between shoulder 323 and shoulder 339.

Figure 15:
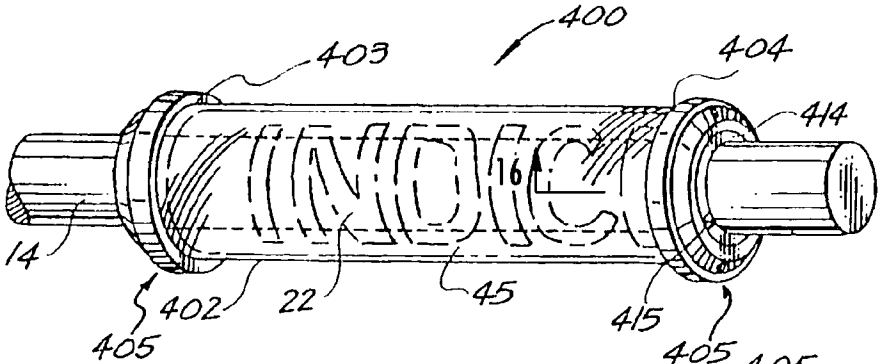
FIG. 15 is an isometric view of a preferred embodiment of the present invention.
Figure 16:
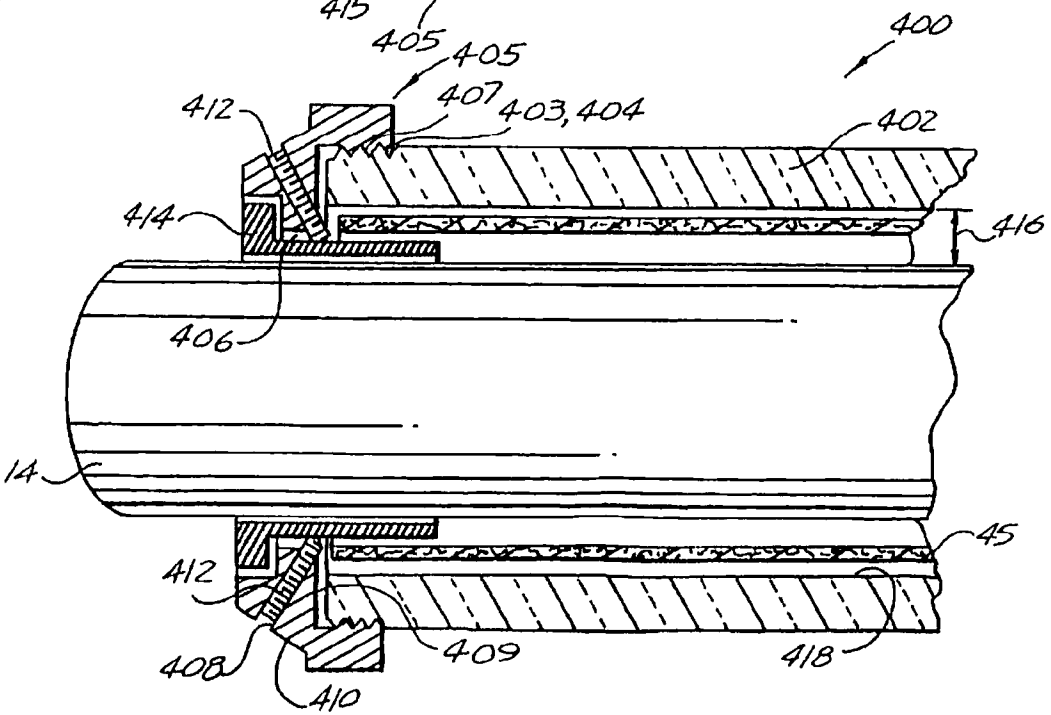
FIG. 16 is a partial sectional view of the embodiment of FIG. 15 taken along line 16—16.

Turning now to FIGS. 15 and 16, and again to FIG., a preferred embodiment of the indicia device, generally designated 400, for use on turnstile 10 and to be received by the arms 14, is illustrated and described herein. The device 400 includes a transparent tubular sleeve 402 having opposing threaded ends 403, 404 for receiving a collar 405 at each of the ends 403, 404. As illustrated with reference to FIG. 15, the collar 405 is intended to be identical for each tubular sleeve end 403, 404, which provide economy and ease in the operation and installation of the invention. As earlier described with reference to alternate embodiments of the present invention, the sleeve 402 is configured to receive the arm 14 therethrough. For the embodiment illustrated with reference to FIGS. 15 and 16, the collars 405 secure the sleeve 402 to the arm 14.

Again with reference to FIGS. 15 and 16, the collar 405 includes a bore 406 for receiving the arm 14. The collar 405 further includes threaded holes 408 formed into a shoulder 410 about the periphery of the collar 405 through which set screws 412 are threaded. The bore 406 is dimensioned for loosely receiving the arm 14. The set screws 412 can be biased against the arm 14 for frictionally securing the collar 405 to the arm 14. However, in the preferred embodiment herein described with reference to FIGS. 15 and 16, a compression ring 414 is received by the arm 14 and is positioned between the arm 14 and collar 405. As illustrated again with reference to FIG. 16, a peripheral portion of each collar 405 includes a threaded bore 407 which receives the threaded sleeve ends 403, 404. The bore 407 terminates at a shoulder surface 409 within the collar 405. The shoulder surface 409 acts as a stop for the sleeve ends 403, 404 and a seal as the sleeve ends 403, 404 are threaded into the collar 405.

In operation, a portion of the compression ring 414 is positioned within bore 406 for communication with the set screws 412. Further, the compression ring 414 includes a split 415 formed within its wall for permitting the ring 414 to reduce its inside diameter as the screws 412 are biased against the ring 414. As the screws 412 are threaded toward the arm 14, the ring 414 compresses, causing the ring 414 to be removably secured to the sleeve 402. The ring 414 is secured to the collar 405, and thus the sleeve 402 secured to the arm 14.

The sleeve 402, as was earlier described for alternate embodiments, provides a gap 416 or space between the arm 14 and a sleeve inside surface 418 thus permitting the sheet 45 having indicia 22 thereon to be viewed from the passageway 16 described with reference to FIGS. 1 and 2. Various steps can be taken to place the indicia 22 for viewing by persons moving through the passageway 16. By way of example, it is anticipated that the sheet 45 containing the indicia 21, will be rolled up and inserted into position within the sleeve 402. With the compression ring 414 loosely fitted into the collar bore 406, one ring 414 and collar 405 combination is threaded onto each end 403, 404 of the sleeve 402. The assembled device 400 is then slipped onto the arm 14 from its free end 15. The device 400 is rotated about the arm 14 for positioning the indicia 22 for viewing by persons moving through the passageway 16. The set screws 412 are tightened for securing the device 400 to the arm 14 as earlier described As described, this invention may be embodied in many different forms and the detailed description of a particular form should not be construed as limiting the embodiments set forth herein. Rather, these embodiments are provided so that this disclosure will be thorough and complete, and will fully convey the scope of the invention to those skilled in the art.

The tubular sleeves of the preceding embodiments are preferably constructed of a transparent material through which the indicia is visible, although opaque material may be used with indicia printed thereon. Substantially any clear material may be employed for a tubular sleeve, however, it must be strong enough to withstand repeated contact by individuals passing through the passageway. The preferred material for a tubular sleeve is caste acrylic, an extruded acrylic or polycarbonate. One skilled in the art will understand that while a transparent tubular sleeve 23 containing a sheet 45 is preferred, a tubular sleeve may be employed having indicia directly thereon or attached to the outer surface thereof. As earlier described, each of the collars may be constructed of substantially any material, such as metal or plastic.

Other features not specifically illustrated have been contemplated for use with the indicia devices described previously. These include lighting installed within the tubular member to back light indicia contained therein.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A method of displaying advertising method comprising:

providing a turnstile for defining a passageway, the turnstile having an arm movable into the passageway for blocking passage of a person therethrough, the arm moveable out of the passageway for permitting passage of the person therethrough, the arm having an outside surface defined by a generally circular cross section;

encircling a substantial portion of the arm outside surface, as defined by the generally circular cross section, with a sleeve extending less than a full length of the portion of the arm extending into the passageway; and providing the advertising on the sleeve, wherein the advertising extends substantially around the arm and is disposed between the arm and the sleeve, and wherein the advertising is positioned for viewing by the person passing through the passageway when the arm is positioned therein.

2. A method according to claim 1, further comprising the sleeve having at least a transparent portion for viewing the advertising therethrough.

3. A method according to claim 1, further comprising:

providing a collar for removably securing the sleeve to the arm; and securing the sleeve to the arm using the collar.

4. A method according to claim 1, further comprising providing a sheet for carrying the advertising thereon.

5. A method according to claim 1, wherein the sleeve comprises a transparent portion, and wherein the advertising is carried within the sleeve for viewing the advertising therethrough.

6. A method according to claim 1, wherein the sleeve comprises a tubular sleeve having an outside surface defined by a generally circular cross section.

7. A method according to claim 6, wherein the advertising is fixedly attached to the sleeve.

8. A method of displaying advertising method comprising:

providing a turnstile for defining a passageway, the turnstile having an arm movable into the passageway for blocking passage of a person therethrough, the arm moveable out of the passageway for permitting passage of the person therethrough, the arm having an outside surface defined by a generally circular cross section;

providing a sleeve;

providing the advertising on the sleeve;

sliding the sleeve onto the arm with the sleeve carrying the advertising between the arm and the sleeve for viewing by the person passing through the passageway when the arm is positioned therein, wherein the sleeve encircles a substantial portion of the arm outside surface and extends less than a full length of the portion of the arm extending into the passageway and wherein the advertising extends substantially around the arm;

sliding the sleeve off of the arm; and sliding at least one of the sleeve and an alternate sleeve onto the arm, wherein alternate advertising is carried by the at least one of the sleeve and the alternate sleeve for viewing by the person passing through the passageway when the arm is positioned therein.

9. A method according to claim 8, wherein the at least one of the sleeve and the alternate sleeve comprises a transparent portion.

10. A method according to claim 8, wherein the at least one of the sleeve and the alternate sleeve comprises a tubular sleeve having an outside surface defined by a generally circular cross section.

11. A method according to claim 8, further comprising providing a sheet for carrying at least one of the advertising and the alternate advertising thereon.

* * * * *

UNITED STATES PATENT AND TRADEMARK OFFICE

CERTIFICATE OF CORRECTION

PATENT NO. : 7,096,625 B1
APPLICATION NO. : 09/705152
DATED : August 29, 2006
INVENTOR(S) : Martin Hering It is certified that error appears in the above-identified patent and that said Letters Patent is hereby corrected as shown below:

| | |
|---|---|
| Column 3, Line 27 | Please delete "11" and insert --10--therefore. |
| Column 13, Line 7 | Please delete "method" after the word "advertising" |
| Column 14, Line 3 | Please delete "method" after the word "advertising" |

Signed and Sealed this

Ninth Day of January, 2007

JON W. DUDAS
*Director of the United States Patent and Trademark Office*